United States Patent [19]

Schmid

[11] 4,131,153

[45] Dec. 26, 1978

[54] ROLLER APRONS FOR A MULTIPLE STRAND BILLET- OR BLOOM CASTING INSTALLATION CONTAINING MORE THAN TWO STRANDS FOR THE CONTINUOUS CASTING OF METALS, ESPECIALLY STEEL

[75] Inventor: Markus Schmid, Zürich, Switzerland

[73] Assignee: Concast AG, Zürich, Switzerland

[21] Appl. No.: 786,639

[22] Filed: Apr. 11, 1977

[30] Foreign Application Priority Data

May 19, 1976 [CH] Switzerland ..... 6250/76

[51] Int. Cl.[2] ..... B22D 11/12

[52] U.S. Cl. ..... 164/442; 198/624; 198/789

[58] Field of Search ..... 164/442; 198/624, 780, 198/789, 790, 791

[56] References Cited

U.S. PATENT DOCUMENTS

| | | | |
|---|---|---|---|
| 3,548,920 | 12/1970 | Torban et al. | 164/442 X |
| 4,036,284 | 7/1977 | Hoffmann | 164/442 X |

*Primary Examiner*—Richard B. Lazarus

*Attorney, Agent, or Firm*—Werner W. Kleeman

[57] ABSTRACT

A strand guide arrangement or roller aprons for a multiple strand billet- or bloom casting installation containing more than two strands for the continuous casting of metals, especially steel, wherein rollers of the at least partially curved roller aprons are individually driven by drive elements through the agency of power transmission shafts, the drive elements being arranged externally of the outer roller aprons. The roller aprons are subdivided into segments. The power transmission shafts associated with the rollers of the inner roller apron extend below one of the outer roller aprons and up to a location in front of the inner roller apron.

6 Claims, 2 Drawing Figures

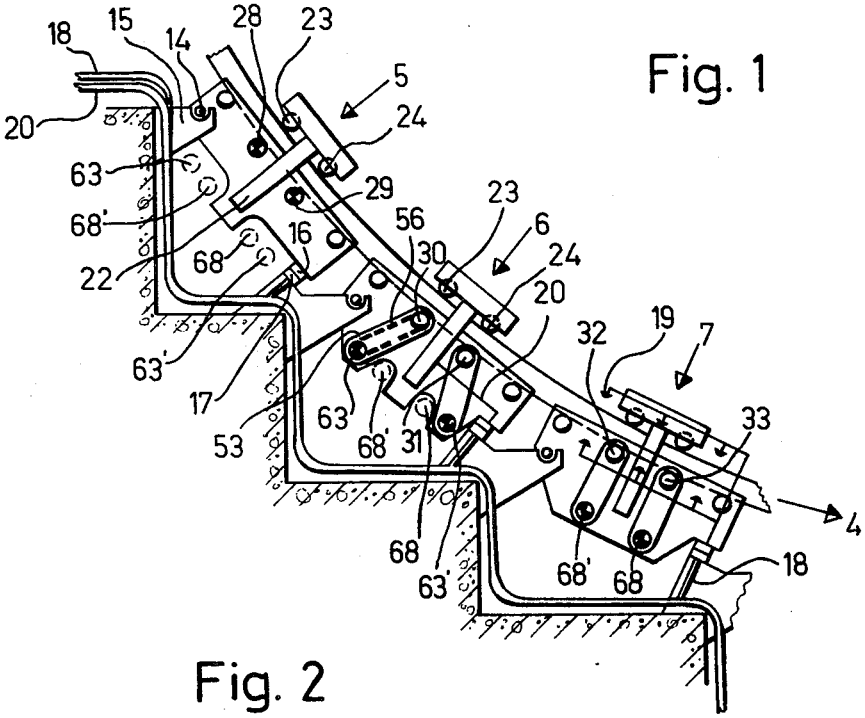
Fig. 1
Fig. 2
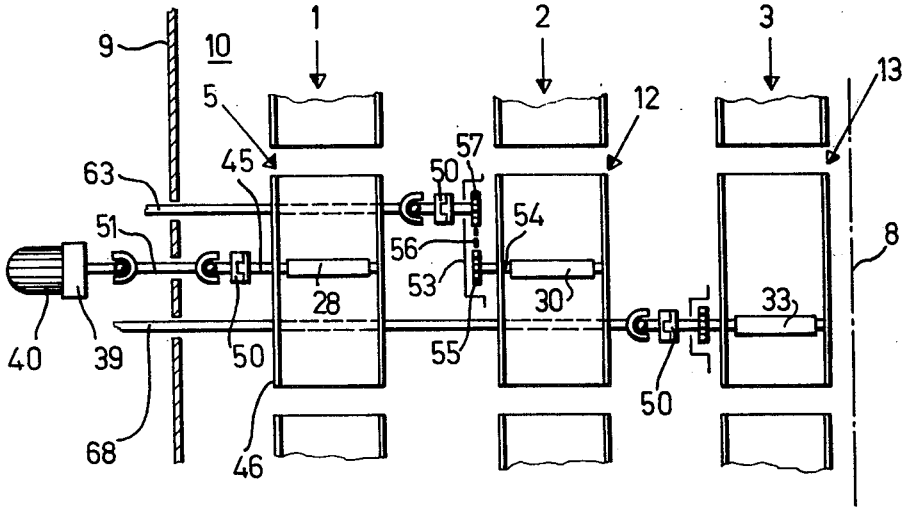

ROLLER APRONS FOR A MULTIPLE STRAND BILLET- OR BLOOM CASTING INSTALLATION CONTAINING MORE THAN TWO STRANDS FOR THE CONTINUOUS CASTING OF METALS, ESPECIALLY STEEL

BACKGROUND OF THE INVENTION

The present invention relates to a new and improved construction of roller aprons or strand guide arrangement for a multiple strand billet- or bloom casting installation containing more than two strands for the continuous casting of metals, especially steel, wherein rollers or rolls of the at least partially curved roller aprons are driven individually by means of drive elements through the agency of power transmission shafts, the drive elements being arranged externally of the outer roller aprons.

The driving of driving rollers or the withdrawal and straightening rollers of a single-strand continuous casting installation is relatively simple to accomplish, since one or more motors are arranged adjacent the roller apron in an approximately coaxial position with respect to the rollers to be driven and are connected with such rollers by means of rigid or flexible shafts.

In the case of a twin-strand continuous casting installation the drive shafts of the related rolls of the second strand extend in the opposite direction, so that in this case the drive motors are located at the sides of both roller aprons which face away from one another. The spacing between the strands, which should be as small as possible for reasons well known in this technology (optimum utilization of the surface area, short tundish), is not in any way adversely affected.

In the case of multiple strand-continuous casting installations working with more than two strands for casting billets and blooms, the arrangement of the roller drives of the inner strands is, however, contradictory to the requirement for small spacing between the strands.

Owing to the smaller strand sectional shape or format for such installations and the therewith attendant smaller danger of bulging-out of the strand, the roller spacing is correspondingly great in the secondary cooling zone. The rollers, therefore, predominantly serve a guiding function. In the case of large strand sectional shapes or formats, for instance slabs, such rollers or rolls carry out as their primary function a supporting function and, therefore, there is selected a small roller spacing. The smaller strand shapes and the larger roller spacing in the case of billet- and bloom casting installations result in a significantly lower weight of the roller aprons or strand guide assembly in the secondary cooling zone. This lower weight does not require any subdivision of the roller aprons into selectively removable segments. The exchange of damaged parts of a roller apron is accomplished by withdrawing the entire roller apron or by time-consuming replacement of the damaged parts in the cooling compartment or chamber. However, with respect to space requirements and costs it is not possible to consider as economical the exchange of an entire roller apron.

Such installations are equipped with long dummy bars. If, however, there should be used short dummy bars, then there are required, apart from the drives for the withdrawal and straigtening unit also drives of some type for a limited number of rollers in the secondary cooling zone. The arrangement of electric motors with associated drives or gearing in the cooling chamber is complicated and owing to the hot, vapor-containing atmosphere which prevails therein there is impaired the operational reliability of the system. For the removal of a damaged roller apron such drives require, however, an initial dismantling and subsequent mounting thereof, resulting in longer downtimes of the entire continuous casting installation.

It is already known to arrange drive motors for the withdrawal and straigtening unit, in the case of multiple strand continuous casting installations, externally of the cooling chamber at the inside radius above the roller aprons, with articulated spindles extending downwardly at an inclination with respect to the rollers. However, this solution impairs the mounting or disassembly of the roller apron elements of the roller apron arranged therebelow. Also there must be employed stationary control panels or consoles for the motors, resulting in additional constructional expenditure.

It is also known in the art to extend at a withdrawal and straightening machine a roller over the width of the total number of strands and to drive such by means of a motor. However, such type common drive or driving roller for all of the strands requires an undesired drive coupling, which, for instance in the case of metal breakout at one of the strands, requires stoppage of the entire continuous casting installation. It is impossible to cast with non-controllable tundish-pouring outlets.

Furthermore, it is known in the case of three-strand and four-strand continuous casting installations to drive two rollers by means of independent motors, these rollers belonging to different roller aprons and being disposed transverse to the casting direction in alignment adjacent one another. Both of the motors are arranged at the same side externally of the outer roller aprons. The power transmission shaft for the drive rollers of the inner roller apron extends through the central bore of the drive rollers of the outer roller aprons. That this construction is complicated should be self-evident. For practical reasons, in this manner only rollers of two neighboring roller aprons can be driven, so that there can be constructed installations containing a maximum of four strands with a mirror-image arrangement of the motors. A great disadvantage furthermore resides in the fact that the dismantling of a driven roller of the outer roller apron simultaneously requires the dismantling of the corresponding drive rollers of the inner strand.

SUMMARY OF THE INVENTION

Hence, it is a primary object of the present invention to provide a new and improved construction of strand guide assembly or roller aprons for a multiple strand billet- or bloom casting installation operating with more than two strands for the continuous casting of metals, especially steel, which is not associated with the aforementioned drawbacks and limitations of the prior art proposals.

Another significant object of the present invention aims to rendering possible, in the case of billet- or bloom continuous casting installations operating with more than two strands, the mounting and dismantling of driven and non-driven rollers in an economical and quicker manner and independent of neighboring roller aprons, and at the same time rendering possible small spacing between the strands which is as uniform as possible.

Still a further object of the present invention aims at the construction of a continuous casting installation of the aforementioned type which simplifies the drive construction and renders the same extremely operationally reliable.

Yet a further significant object of the invention aims at providing a new and improved construction of strand guide assembly or roller aprons for a multiple strand billet- or bloom casting installation operating with more than two strands for the continuous casting of metals, especially steel, which is relatively simple in construction and design, economical to manufacture, extremely reliable in operation, requires a minimum of maintenance and servicing, and is not readily subject to breakdown and malfunction.

Now in order to implement these and still further objects of the invention, which will become more readily apparent as the description proceeds, one of the important teachings of the invention comtemplates subdividing the roller aprons into segments and the power transmission shafts associated with the rollers of the inner roller apron extend below one of the outer roller aprons and to a location in front of the inner roller apron.

By means of the solution proposed by the invention it is possible, in the case of multiple strand-continuous casting installations operating with three or more strands, to lift-out or exchange segments containing driven rollers selectively and thus economically and independently of neighboring segments from the cooling chamber or compartment. The guiding of the power transmission shafts below at least one of the outer roller aprons, on the one hand, enables arranging the drive elements externally of the cooling chamber, rendering possible small spacing between the strands, simplifying the construction and increasing the operational reliability and, on the other hand, allows exchanging segments without impairing the drive elements of neighboring segments, and this requires a smaller expenditure in time. The roller aprons are uniformly distributed over the entire width of the installation and the power transmission shafts are as short as possible.

According to one feature of the invention it is recommended to suspend the segments at their upper end regions in upwardly open stationary pivot bearings and to have their lower end regions contact against stationary stops which are detachably connected therewith. This particular arrangement of the segments is intended to enable rapid exchange thereof. This is especially of importance in the case of a multiplicity of segments of a multiple-strand continuous casting installation in a cooling chamber, because then the time that the cooling chamber is open and thus the down time of the installation can be reduced. Such pivoting or rocking of the segments is completely possible due to the larger roller spacing in the case of billet- and bloom continuous casting installations.

According to a further feature of the invention, the stationary stops or impact members and the end regions of the segments bearing thereat form coupling plates which contain connections for the operating means. Consequently, the construction of the segments is simplified and rendered operationally reliable and there is shortened the time needed for segment lift-out or removal.

An advantageous further construction of the invention is realized inasmuch as the power transmission shafts of the rollers of the inner roller apron possess releasable couplings located between the last-mentioned inner roller apron and the neighboring roller apron. As a result, the power transmission to the driven rollers can be accomplished without interruption quickly and in a simple manner, so that lifting-out of the damaged segments can be achieved without having to dismantle further parts of the power transmission means. The couplings are arranged in a space-saving manner in a space which is required anyway at both sides of each strand for the cutter device provided for each strand.

The power transmission shafts advantageously cooperate with drives or gearing means attached to the segments. In this way there is rendered possible a parallel displacement downwardly in the power transmissions, which facilitates the arrangement of the laterally dispositioned drive elements. Additionally, by virtue of the selection of the transmission ratio there can be influenced the rotational speed of the rollers.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a side view of a portion of a six-strand continuous casting installation embodying the invention; and FIG. 2 is a partially illustrated top plan view of three strands of the installation of FIG. 1.

DETAILED DESCRIPTION OF THE PREFERRED EMBODIMENTS

Describing now the drawings, it is to be understood that for purposes of simplification thereof only enough of the construction of a continuous casting installation for the casting of metals, especially steel, and embodying the teachings of the invention, has been shown in order to enable persons skilled in the art to readily understand the underlying concepts of the invention. Thus, turning attention to FIGS. 1 and 2 there is illustrated therein part of a six strand-arc-type-continuous casting installation for the continuous casting of steel blooms, which part is located in the secondary cooling zone.

Roller aprons or strand guide assemblies, 1, 2, 3 are subdivided into the segments 5, 6, 7 respectively. The arrow 4 indicates the direction of withdrawal of the continuously cast strand. To the other side of the central line 8, shown in FIG. 2 there are arranged in identical but mirror-image fashion the roller aprons, segments, drives and so forth for the additional three strands which have not been portrayed in such FIG. 2, and omitted to simplify the showing of the drawing. The outer side of the roller apron 1 has associated therewith a vertical wall portion 9 of a common cooling chamber or compartment 10 for all of the roller aprons. Also, in the showing of FIG. 2 the segments for the outer roller apron 1 have been designated by reference character 5, the segments for the intermediately arranged roller apron 2 by reference character 12 and the segments for the central roller apron 3 by reference character 13.

All of these segments arranged in the curved part of the roller aprons are equipped at their upper end region with pins or plugs 14 which are suspended in upwardly open, stationary pivot bearings 15 or equivalent structure and possess at their lower end or terminal regions 16 stationary stops or impact members 17. The end regions and the stops form coupling plates or pairs of coupling plates. Each coupling plate pair 16, 17, the plates of which in the operating condition are fixed, for instance, by means of a wedge or other suitable means against one another, contain operating means-connections for water infeed lines or conduits 18 leading to the spray nozzles 19 and for hydraulic infeed and withdrawal lines 20 leading to the adjustment mechanisms 22 of the counter rollers 23 and 24 located at the inner radius. The lifting-out and the exchange of any such segment can be accomplished by means of a crane, after loosening the wedge and a hereinafter to be described coupling. In so doing, such is initially rocked about the pins 14 into the horizontal and subsequently vertically lifted-out.

In the illustrated exemplary embodiment, at each segment 5, 6, 7, 12, 13, there are driven two rollers 28, 29 and 30, 31, and 32, 33 respectively. These rollers are located at the fixed sides of the roller aprons, i.e. at the side of the outer radius. They are individually driven by drive elements or drive means in the form of electric motors 40 equipped with the transmissions or gearing 39 and arranged externally of the outer roller aron 1 and the cooling chamber 10.

In FIG. 2 there have not been illustrated the driven rollers 29, 31 and 32 because they are identical to the rollers 28, 30 and 33. For the sake of simplicity there is only illustrated a drive motor 40 with the transmission or gearing 39, but it should be understood however that each driven roller 28, 29, 30, 31, 32 and 33 has operatively associated therewith its own drive motor. The journal or trunnion 45 of the roller 28 which confronts the wall portion 9 passes through the left side plate 46 of the segment 5 and is connected by means of a detachable disc coupling 50 arranged between the roller apron 1 and the wall portion 9 and through the agency of a power transmission shaft in the form of a Cardan or universal-joint shaft 51 with the drive motor 40. The Cardan universal-joint shaft 51 — as well as all other Cardan shafts — pass through the vertical wall portion 9 and extend approximately horizontally with regard to the motor 40 which is mounted upon a not particularly illustrated, stationary socket or pedestal.

The extended journal or trunnion 54 of the roller 30 of the inner roller apron 2 is connected at its free end, directed towards its drive motor, with a gearing or transmission 53 secured to the segment 12. This gearing 53 consists of sprocket gears 55, 57 which coact with a chain 56. This sprocket gearing 53 can also be replaced by a spur gear drive or other equivalent drive means. The Cardan shaft 63 associated with the roller 39 extends below the segment 5 of the outer roller apron 1 to a location in front of the roller apron 2 (viewed with respect to the drive motor) and is coaxially positioned with respect to the sprocket gear or wheel 57. Consequently, this segment 5 can be lifted-out without any obstruction. The sprocket gear 57 is arranged at the outside of the segment 12 such that as far as space is concerned there can be established a suitable connection with the Cardan shaft 63. The motor 40 or the motors associated with the Cardan shaft 63 can be arranged in a staggered fashion in the direction of the Cardan or universal-joint shafts if there is insufficient space available. Once again there is provided a releasable coupling 50 which is located in the space between the segments 5 and 12. During dismantling of the segment 12 the universal-joint shaft or Cardan shaft 63 need not be dismantled and can remain in its stationary, bearing means at the side of the segment.

A further Cardan shaft or universal-joint shaft 68 extends both below the outer roller apron 1 as well as also below the inner roller apron 2 to a location before the roller 33 of the segment 13 (viewed from the drive motor) of the inner roller apron 3. Just as was the case for the sprocket gearing or drive 53 of the segment 12 also here the universal-joint shaft 68 is connected by means of a releasable coupling 50 with its sprocket gearing. The Cardan shaft or universal-joint shaft 68 and its equivalent, i.e., the universal-joint shaft 68' which is operatively connected with the roller 32, are located between the adjustment mechanism 22 on the one hand and the universal-joint shaft 63 and its equivalent, that is to say, the universal-joint shaft 63' which is operatively connected with the roller 31 on the other hand. The universal-joint shafts 63, 63' and 68, 68' located beneath the segment 5 have been shown in broken or phantom lines in FIG. 1.

Although the described segments in each case exhibit two driven rollers, embodiments of segments are conceivable which employ in each case one driven roller.

The exemplary embodiment has been explained on the basis of a six strand-continuous casting installation. However, the invention can be readily utilized in conjunction with three- to eight strand continuous casting installations. Furthermore, the segments of the invention also can be arranged in the linear part of a roller apron, for instance at vertical casting installations having a subsequent arcuate or arc-shaped portion.

The invention is employed advantageously with installations the segments of which utilize driven rolls and essentially need not fulfill any supporting function with respect to the ferrostatic pressure, as such is the case for billet-, bloom- and beam blank- continuous casting installations.

While there are shown and described present preferred embodiments of the invention, it is to be distinctly understood that the invention is not limited thereto, but may be otherwise variously embodied and practiced within the scope of the following claims.

Accordingly, what I claim is:

1. A strand guide arrangement for a multiple strand billet or bloom casting installation working with more than two strands for the continuous casting of metals, especially steel, comprising;

a plurality of at least partially curved roller aprons for supporting the cast strands and extending in a casting direction, said roller aprons including inner roller aprons, neighboring roller aprons arranged on both lateral sides of said inner roller aprons and outer roller aprons, said outer roller aprons having only on one lateral side thereof a neighboring roller apron, each roller apron being subdivided into segments in said casting direction, each of said segments including rollers supporting the cast strand;

a power transmission shaft operatively connected to at least one of the rollers of each roller apron and individual drive means connected to each respective power transmission shaft for driving said one roller said drive means being arranged substantially laterally outwardly of the other lateral side of at least one of said outer roller aprons;

each power transmission shaft which extends between a respective drive means and a respective roller of the inner roller aprons being arranged beneath one of the segments of the outer roller aprons and terminating at a location between the associated inner roller apron and its respective drive means whereby said one outer roller apron segment is removable from the casting installation without obstruction.

2. The strand guide arrangement as defined in claim 1, wherein:

each of said segments has an upper end region and a lower end region;

means for releasably supporting said segments including upwardly open stationary pivot bearing means for suspending the upper end regions of said segments and stationary stop means for bearing against and supporting the lower end regions of said segments.

3. The strand guide arrangement as defined in claim 2, wherein:

said stationary stop means and the end regions of the segments bearing thereat comprise coupling plates which include connection means for supplying an operating fluid medium to the strand guide arrangement.

4. The strand guide arrangement as defined in claim 1, wherein:

said power transmission shafts connected to the rollers of the inner roller apron comprise detachable couplings located between said inner roller apron and a next outwardly adjacent neighboring roller apron.

5. The strand guide arrangement as defined in claim 1, wherein:

said power transmission shafts are drivingly connected with gearing means secured to the segments for driving said given rollers.

6. The strand guide arrangement as defined in claim 1, further including:

means defining a common cooling chamber for the roller aprons, said drive means being located externally of said common cooling chamber.

* * * * *